United States Patent [19]

Warning

[11] 4,300,888

[45] Nov. 17, 1981

[54] REMOTE OUTBOARD MOTOR STEERING CONTROL

[76] Inventor: Richard L. Warning, 973 S. Quail Way, Lakewood, Colo. 80226

[21] Appl. No.: 107,670

[22] Filed: Dec. 27, 1979

[51] Int. Cl.[3] ..... B63H 21/26

[52] U.S. Cl. ..... 440/62; 114/144 R

[58] Field of Search ..... 248/642; 318/588; 114/144 R, 144 RE, 144 A; 440/49, 53, 55, 56, 58–65, 76, 77, 79, 900

[56] References Cited

U.S. PATENT DOCUMENTS

| | | | |
|---|---|---|---|
| 2,666,407 | 1/1954 | Wilkirson | 114/144 A |
| 3,968,768 | 7/1976 | Solt | 440/62 |

*Primary Examiner*—Frank Sever

*Attorney, Agent, or Firm*—Harvey B. Jacobson

[57] ABSTRACT

An elongated bar is provided and a mounting bracket is mounted on the bar for guided movement therealong. A reversible electric motor driven capstan is journaled from the mounting bracket, an elongated flexible tension member extends between and is anchored relative to the opposite end portion of the bar and an intermediate portion of the tension member is looped about the capstan. First and second connection structure is carried by the bracket and one end of the bar for releasable universal connection with a first stationary mounting location on a boat and a second steering control mounting location on a lightweight trolling motor oscillatably supported from the boat.

8 Claims, 10 Drawing Figures

FIG. 4
FIG. 3
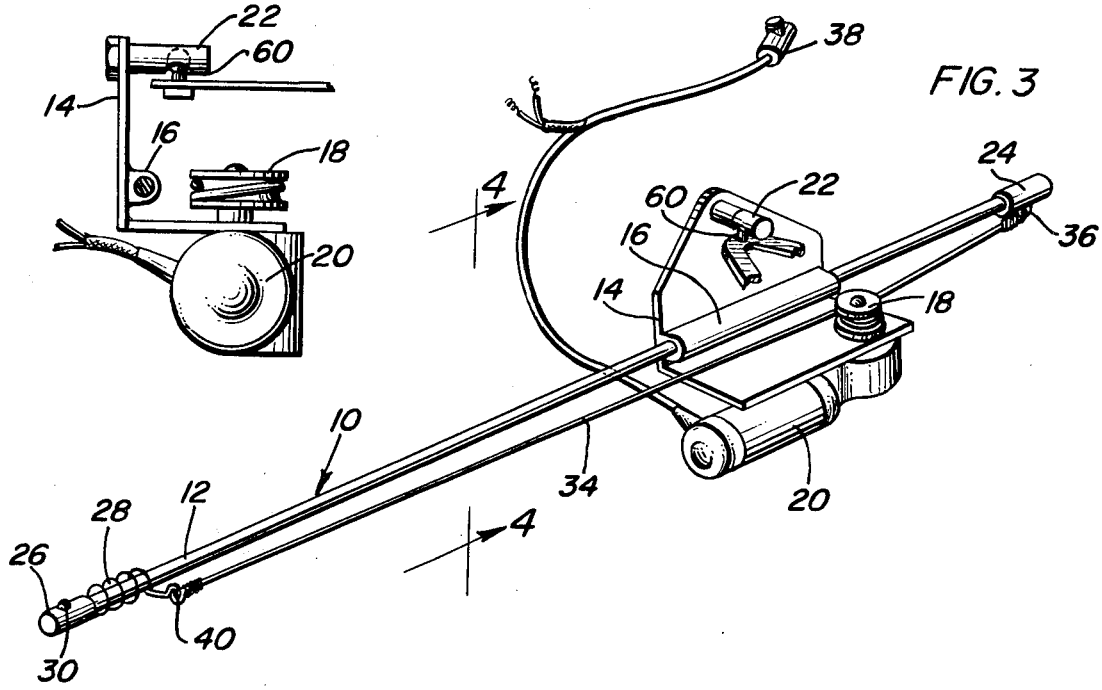
FIG. 8
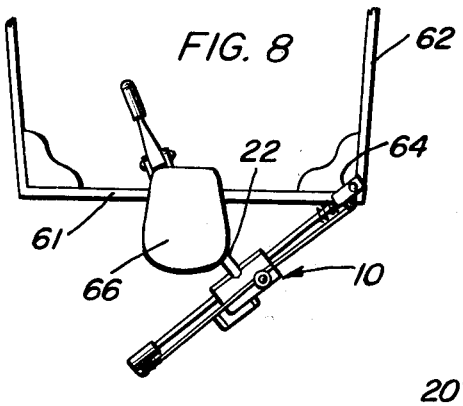
FIG. 9
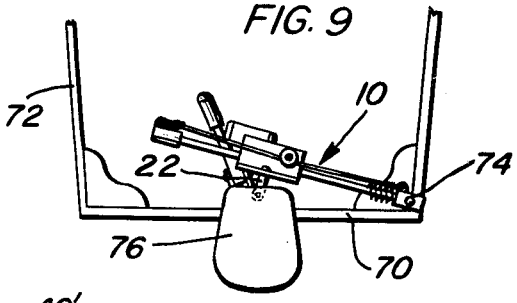
FIG. 10
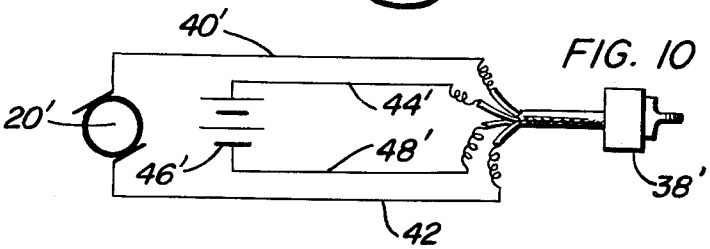
FIG. 7
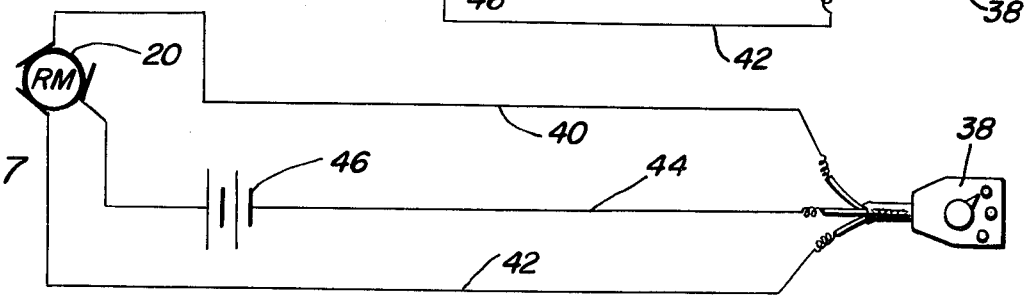

REMOTE OUTBOARD MOTOR STEERING CONTROL

BACKGROUND OF THE INVENTION

Various forms of remote control steering assemblies have been heretofore provided for use in conjunction with lightweight trolling motors. Examples of previously known forms of remote controls of this type as well as additional motor controlling structures are disclosed in U.S. Pat. Nos. 2,545,086, 2,916,008, 3,052,204, 3,711,755, 3,7566,186, 3,881,443, 3,889,625, 3,930,461 and 3,968,768. However, these previously known forms of motor controls and similar structures are not particularly well adapted for ready operative association with substantially all types of trolling motor installations. Accordingly, a need exists for a trolling motor steering control which may be utilized in conjunction with substantially all trolling motor installations.

BRIEF DESCRIPTION OF THE INVENTION

The steering control of the instant invention includes an elongated bar having a bracket mounted thereon for guided movement along the bar and a reversible electric motor driven capstan is journaled from the mounting bracket. An elongated flexible tension member extends between and is anchored relatively to the opposite end portions of the bar and has an intermediate portion thereof looped about the capstan. Connection structure is carried by the bracket and one end of the bar for releasable universal connection with a stationary mounting location on a boat and a mounting location on a lightweight trolling motor mounted on the boat. By utilization of the steering control, the lightweight trolling motor may be controllably angularly displaced relative to the boat in a steering mode. The motor steering control is constructed in a manner whereby it may be readily and quickly adapted for use in substantially all trolling motor installations. In addition, it is wholly operative in conjunction with electric trolling motors as well as gasoline powered trolling motors.

The main object of this invention is to provide a remote control for steering of a lightweight trolling motor.

Another object of this invention is to provide a remote control constructed in a manner whereby it may be quickly and readily adapted to substantially all trolling motor installations.

Still another important object of this invention is to provide a motor control which will be of lightweight construction and may be supported substantially entirely exteriorly of the associated boat to thereby enable full utilization of the interior of the boat without interference from the steering control.

Another important object of this invention is to provide a steering control for a trolling motor which may be operatively connected between the boat and the trolling motor, or, alternately, operatively connected between a lightweight trolling motor and a larger and heavier stationarily suppoted main outboard motor supported from the same boat.

A final object of this invention to be specifically enumerated herein is to provide a remote outboard motor steering control in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a perspective view of the steering control;

FIG. 4 is an enlarged fragmentary transverse vertical sectional view taken substantially upon the plane indicated by the section line 4—4 of FIG. 3;

FIG. 7 is a diagrammatic view illustrating the manner in which a three-wire grounded reverse polarity motor for the capstan may be electrically connected to a suitable control unit;

FIG. 8 is a fragmentary top plan view illustrating a first manner in which the steering control may be operatively associated with a trolling motor used as the sole motor on a boat;

FIG. 9 is a fragmentary plan view illustrating a second manner in which the steering control may be operatively associated with a trolling motor utilized as the sole motor on a fishing boar; and FIG. 10 is a diagrammatic view illustrating the manner in which a two-wire non-grounded reverse polarity motor for driving the capstan may electrically connected to a suitable control.

DETAILED DESCRIPTION OF THE INVENTION

Figure 5:
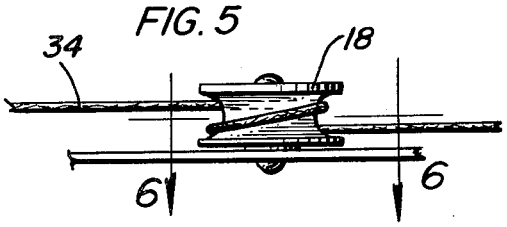
FIG. 5 is a fragmentary enlarged elevational view illustrating the manner in which the flexible tension member of the control is looped about the capstan of the control.
Figure 6:
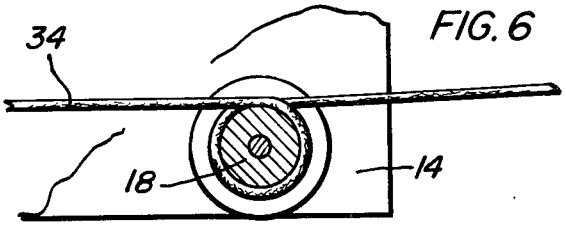
FIG. 6 is a horizontal sectional view taken substantially upon the plane indicated by the section line 6—6 of FIG. 5.

Referring now more specifically to the drawings the numeral 10 generally designates the steering control of the instant invention. The control 10 is illustrated to best advantage in FIG. 3 and may be seen to include an elongated cylindrical bar 12 having a mounting bracket 14 including a tubular guide portion 16 slidably mounted on the bar 12 with the latter slidably received through the tubular guide portion 16. The mounting bracket supports a rotary capstan 18 therefrom driven by a gear reduction motor 20 and the mounting bracket 14 additionally includes a guick disconnect socket construction 22 for a purpose to be hereinafter more fully set forth. The opposite ends of the bar 12 have end pieces 24 and 26 (may be reversible) supported therefrom and one of the end pieces 24, 26 has one end of a coiled expansion spring 28 disposed about the bar 12 anchored relative thereto. The end piece 26 defines a second quick disconnect socket construction 30. Also, it may be seen from FIG. 3 of the drawings that the control 10 additionally includes an elongated flexible tension member 34 having one end anchored to the end piece 24 as at 36 and the other end anchored relative to the coil spring 28 as at 40. An intermediate portion of the tension member 34 is coiled about the capstan, see FIGS. 5 and 6.

It may be seen from FIG. 7 of the drawings that the reversible motor 20 may comprise a three-wire grounded reverse polarity motor wherein the motor includes three brushes electrically connected to a control 38 by three conductors 40, 42 and 44, a source 46 of electrical potential being serially electrically connected in the conductor 44.

On the other hand, with attention invited to FIG. 10, a motor 20' may be utilized of the two-wire grounded, reverse polarity type. When the motor 20' is utilized, it is electrically connected to a suitable control 38' through the utilization of conductors 40' and 42' and the control 38' is also electrically connected to a suitable source 46' of electrical potential through the utilization of a pair of conductors 44' and 48'.

Figure 1:
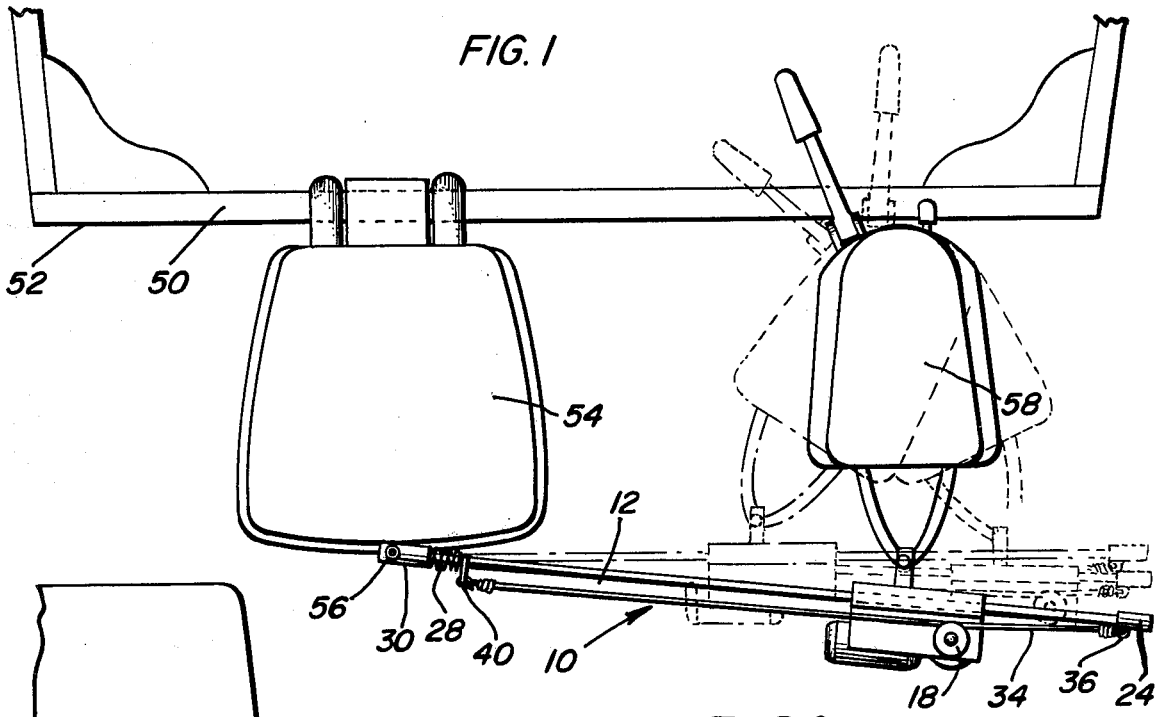
FIG. 1 is a fragmentary top plan view of the transom portion of a fishing boat having a large main propulsion outboard motor supported therefrom and also a lightweight trolling motor supported therefrom, the motor steering control of the instant invention being operatively connected between the main motor and the trolling motor.
Figure 2:
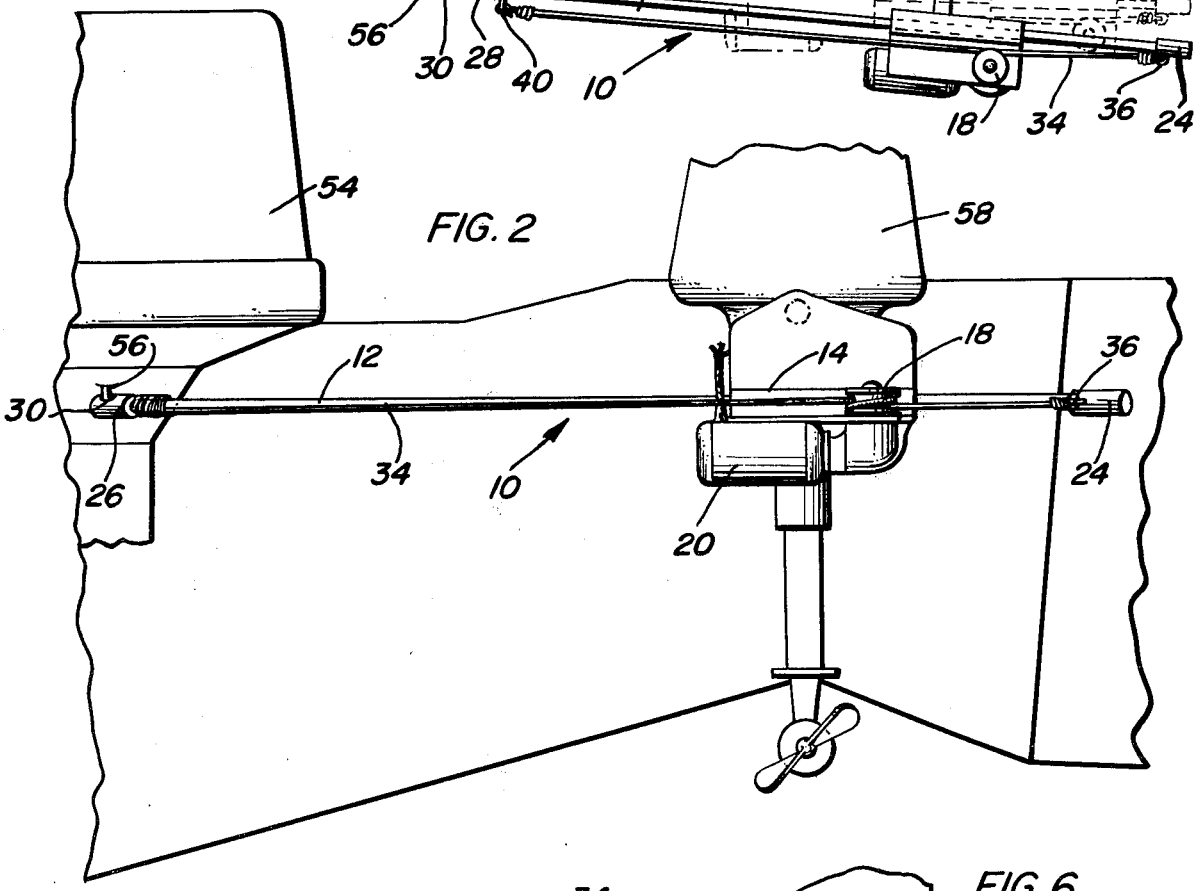
FIG. 2 is a fragmentary rear elevational view of the assemblage illustrated in FIG. 1.

With attention invited now more specifically to FIG. 1 of the drawings, it may be seen that the transom 50 of a boat 52 has a large outboard motor 54 mounted thereon comprising the main propulsion force for the boat 52. The rear of the outboard motor 54 includes a steering knuckle 56 with which the quick disconnect socket construction 30 is releasably engaged. A lightweight trolling motor 58 is also supported from the transom 50 and includes a steering knuckle 60 with which the quick disconnect socket construction 22 is releasably engaged. Accordingly, inasmuch as the outboard motor 54 may be retained in its adjusted position, reverse operation of the motor 20 will effect movement of the mounting bracket 14 along the bar 12 and thus cause the motor 58 to be oscillated relative to the transom 10 for steering purposes. The tension member 34 is tensioned through the utilization of the spring 28, but the tension of the spring 28 is such that movement of the mounting bracket 14 to either end of the bar 12 will cause slippage of the tension member 34 on the capstan 18, which slippage acts as an overload clutch.

In addition to the utilizlation of the steering control 10 between the motors 54 and 58, the steering control 10 may also be utilized in the manner illustrated in FIG. 8 of the drawings with the quick disconnect socket construction 30 anchored relative to one side of the transom 61 of a lightweight fishing boat 62 as at 64, and the quick disconnect socket construction 22 releasably engaged with a steering knuckle (not shown) on the trolling motor 66 mounted on the transom 60. Further, the steering control may also be operatively connected between the transom 70 of the boat 72 illustrated in FIG. 9 as at 74 and with the quick disconnect socket construction 22 releasably connected to a steering knuckle (not shown) corresponding to the steering knuckle 56 carried by the outboard motor 76 mounted on the transom 70.

Although the steering control 10 has been illustrated and described herein as operatively connected between a stationary mounting point and an oscillatable lightweight trolling motor, it is to be noted that the steering control 10 may also be operatively connected between a stationary boat mounting location and an outboard motor utilized as the primary motive force for the boat, at least when that outboard motor is being utilized for trolling purposes.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A remote outboard motor steering control for connection between a first stationary mounting location on a boat and a lightweight trolling motor oscillatably supported from said boat and including a second steering control mounting location, said steering control including an elongated bar, a mounting bracket mounted on said bar for guided movement therealong, a reversible electric motor driven capstan journaled from said mounting bracket, an elongated flexible tension member extending between and anchored relative to the opposite end portions of said bar and having an intermediate portion thereof looped about said capstan, and first and second connection structure carried by said bracket and one end of said bar for releasable universal connection with said mounting locations.

2. The combination of claim 1 wherein one end of said tension member is yieldably anchored relative to the corresponding end of said bar whereby the portion of said tension member looped about said capstan may comprise an overload clutch release connection between said capstan and said tension member.

3. The combination of claim 2 wherein the yieldable connection between said one end of said tension member and the corresponding end of said bar comprises a coiled expansion spring disposed about said bar, one end of said expansion spring being anchored relative to said bar and the other end of said expansion spring having said one end of said tension member anchored relative thereto.

4. The combination of claim 1 wherein said mounting bracket includes an elongated tubular sleeve portion, said bar being slidably and rotatably received through said sleeve portion.

5. The combination of claim 1 including electric control circuit means electrically connected to said electric motor and to a source of electrical potential for selective operation of said motor in opposite directions.

6. The combination of claim 1 including a boat, a primary outboard motor mounted on said boat for main propulsion thereof, a trolling motor mounted on said boat for trolling operations, said first stationary mounting location being disposed on said primary outboard motor and said second steering control mounting location being mounted on said trolling motor.

7. The combination of claim 1 including a boat, a trolling motor mounted on said boat, and oscillatably supported therefrom, said first mounting location being supported directly from said second steering control boat and said mounting location being supported from said trolling motor.

8. The combination of claim 1 including a boat having a first stationary mounting location thereon and a trolling motor oscillatably supported from the boat and including a second steering control mounting location thereon, said first and second connection structures being universally anchored relative to said first and second mounting locations, respectively.

* * * * *